US005584679A

United States Patent [19]

Yang

[11] Patent Number: 5,584,679

[45] Date of Patent: Dec. 17, 1996

[54] GAS LEAKAGE PROTECTION APPARATUS

[76] Inventor: Ch'ang-Hua Yang, No. 246, Min-Chu W. Rd., Taipei City, Taiwan

[21] Appl. No.: 636,354

[22] Filed: Apr. 23, 1996

[51] Int. Cl.[6] ..... F23N 5/00

[52] U.S. Cl. ..... 431/81; 431/86

[58] Field of Search ..... 431/80, 81, 86

[56] References Cited

U.S. PATENT DOCUMENTS 3,764,181 10/1973 Friedrich ..... 431/81

5,181,846 1/1993 Chang ..... 431/80

*Primary Examiner*—Hezron E. Williams

*Assistant Examiner*—Jay L. Politzer

*Attorney, Agent, or Firm*—Morton J. Rosenberg; David I. Klein

[57] ABSTRACT

Gas leakage protection apparatus includes a pressure-differential sealing device and a thermal electricity converting device installed at a burner head for converting the heat of the fire into electric energy which is supplied to a solenoid valve at a bottom of a body to ensure smooth flow of gas through an opening of a gas duct. When the fire is out, the temperature drops so that the converting device cannot supply energy to the solenoid valve, causing the opening to be blocked and gas cut off. The pressure-differential sealing device consists of two interlocking L-shaped connecting tubes. A control element having a small-diameter inner bore and a large-diameter inner bore is disposed in one of the connecting tubes. The wall of the large-diameter inner bore is circumferentially provided with multiple holes. A control rod having a bottom flange fitted with a washer is disposed inside the inner bores of the control element. Under normal circumstances, gas passes through the multiple holes of the control element. But when the gas pipe cracks and the gas pressure increases as a result, the control rod will displace upwardly to seal the gas path, stopping gas leakage.

1 Claim, 10 Drawing Sheets

GAS LEAKAGE PROTECTION APPARATUS

BACKGROUND OF THE INVENTION (a) Field of the Invention

The present invention relates generally to a gas leakage protection apparatus, and more particularly to a gas leakage protection apparatus having a timer, a pressure-differential sealing device and a thermal electricity converting device, in which the gas path is cut off when the fire is blown out by wind or extinguished by overflowing boiling water or soup so as to ensure safety.

(b) Description of the Prior Art

In conventional gas leakage protection apparatus, there is provided a timer for cutting off gas supply at a predetermined time and a steel ball means for automatically blocking the gas outlet when the gas pipe cracks or gas leaks. However, such conventional apparatus becomes ineffective if the fire is blown out by wind or quenched by overflowing boiling water or soup so that gas leakage cannot be stopped.

SUMMARY OF THE INVENTION

Accordingly, a primary object of the present invention is to provide a gas leakage protection device with a timer and pressure-differential sealing device, in which gas flow is automatically cut off when the fire is blown out by wind or quenched by overflowing boiling water or soup to ensure safety.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 8:
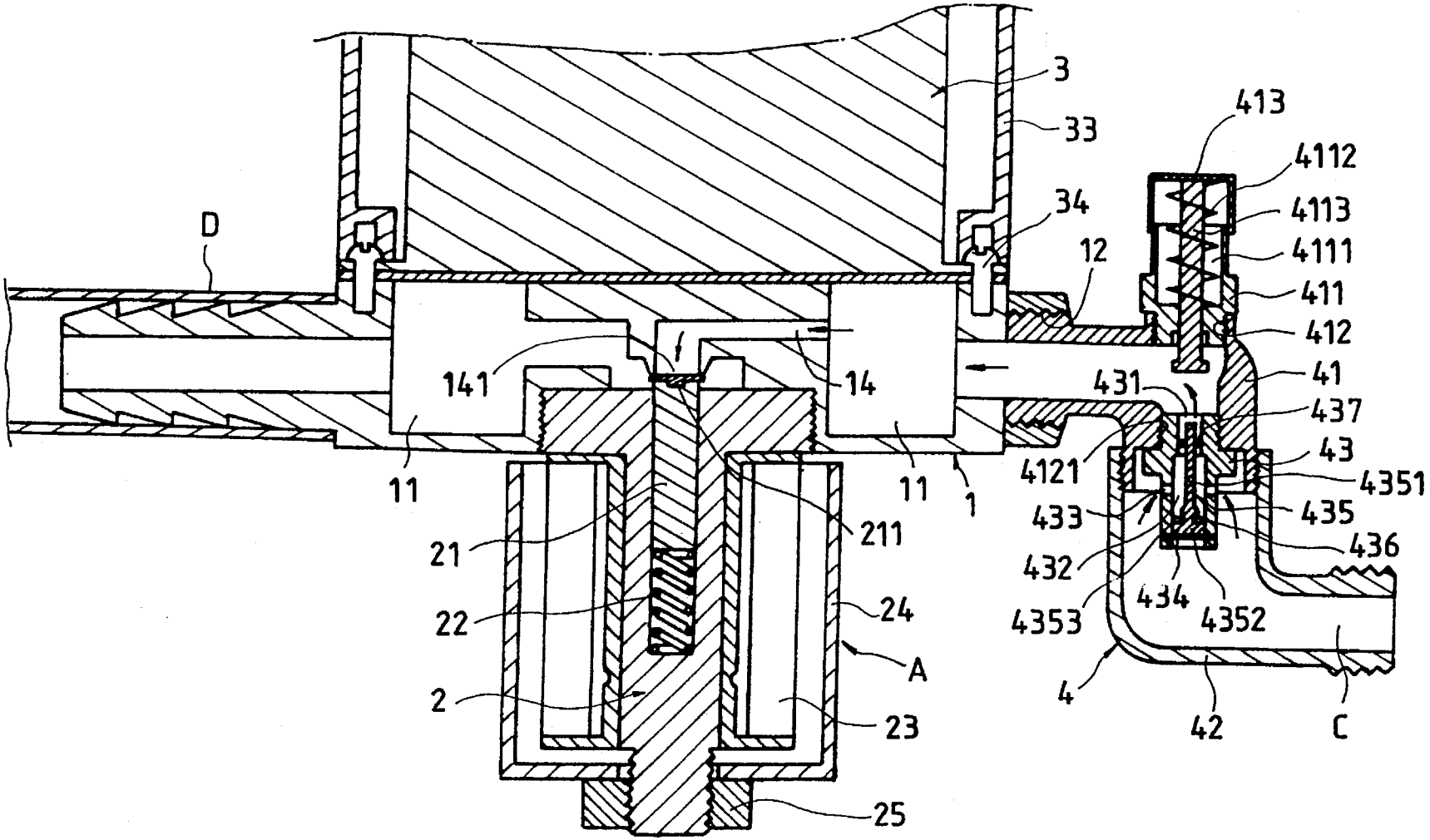
FIG. 8 is a sectional view of the gas leakage protection apparatus in which a rod of a solenoid valve seals a central opening of a first gas duct when electric power supply is interrupted.

With reference to FIGS. 1–7, the present invention essentially comprises a body 1 having an interior longitudinally divided into two spaces 11 by an intermediate partition 111. A first duct 14 and a second duct 15 respectively provided at suitable positions at the lateral sides of the intermediate partition 111. The first duct 14 has a longitudinally oriented opening 141 disposed at a central portion thereof. A solenoid valve A is screwably arranged at a lower end of the body 1 at a position relative to that of the opening 141. The solenoid valve A consists of a solenoid valve body 2 screwably locked with the body 1, a coil 23 and a jacket 24 fitted respectively onto the solenoid valve body 2, with a nut 25 locked to a lower end of the solenoid valve body 2. A spring 22 and a rod 21 are further inserted into an inner bore of the solenoid valve body 2. A top end of the rod 21 is fitted with a cock 211. When the solenoid valve A is not connected with electric currents, the rod 21 is urged by the spring 22 to push against the first duct 141 (as shown in FIG. 8).

Figure 10:
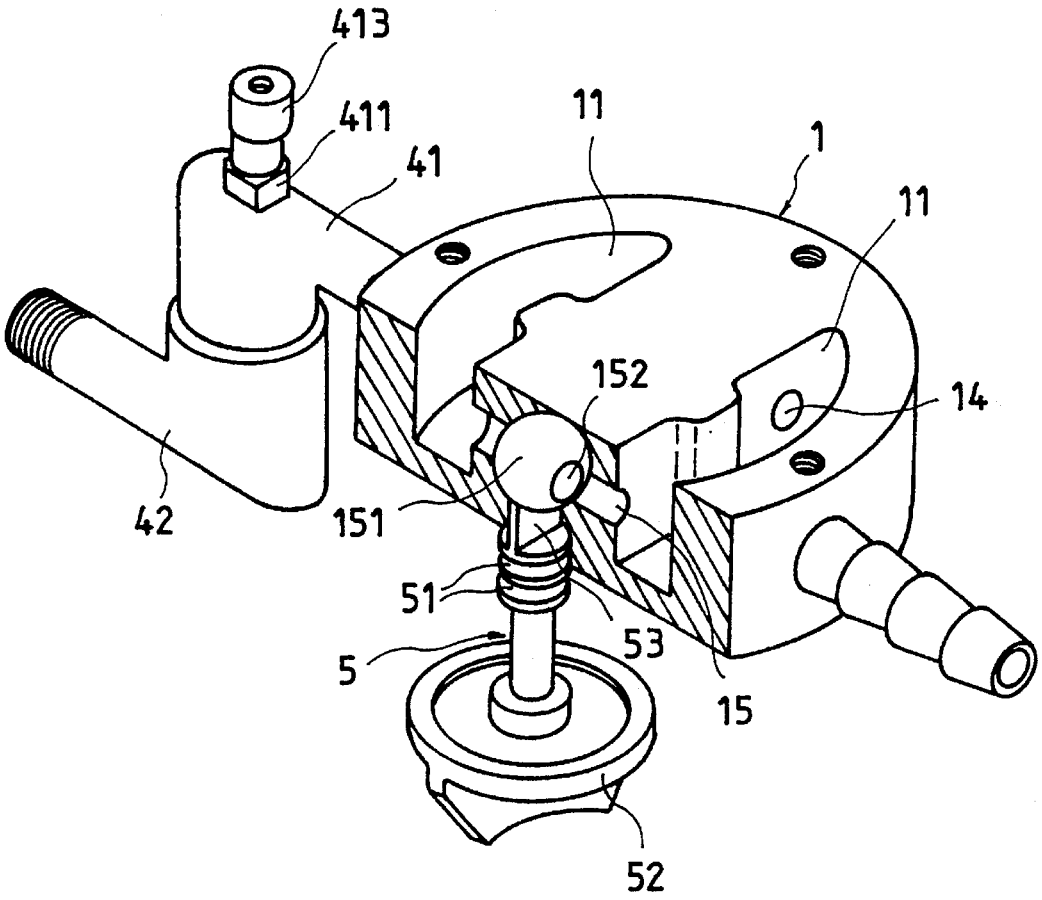
FIG. 10 is an elevational schematic view illustrating a manually operable valve means consisting of a spherical body and a rotary rod of the invention.
Figure 12:
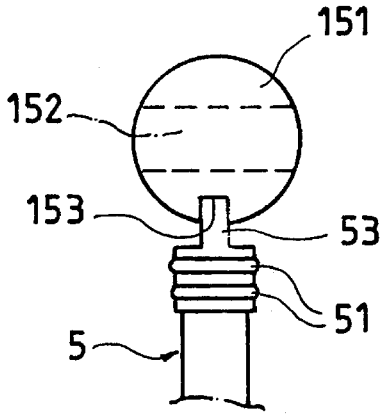
FIG. 12 is a schematic sectional view of the manually operable valve means of the invention in part.
Figure 11:
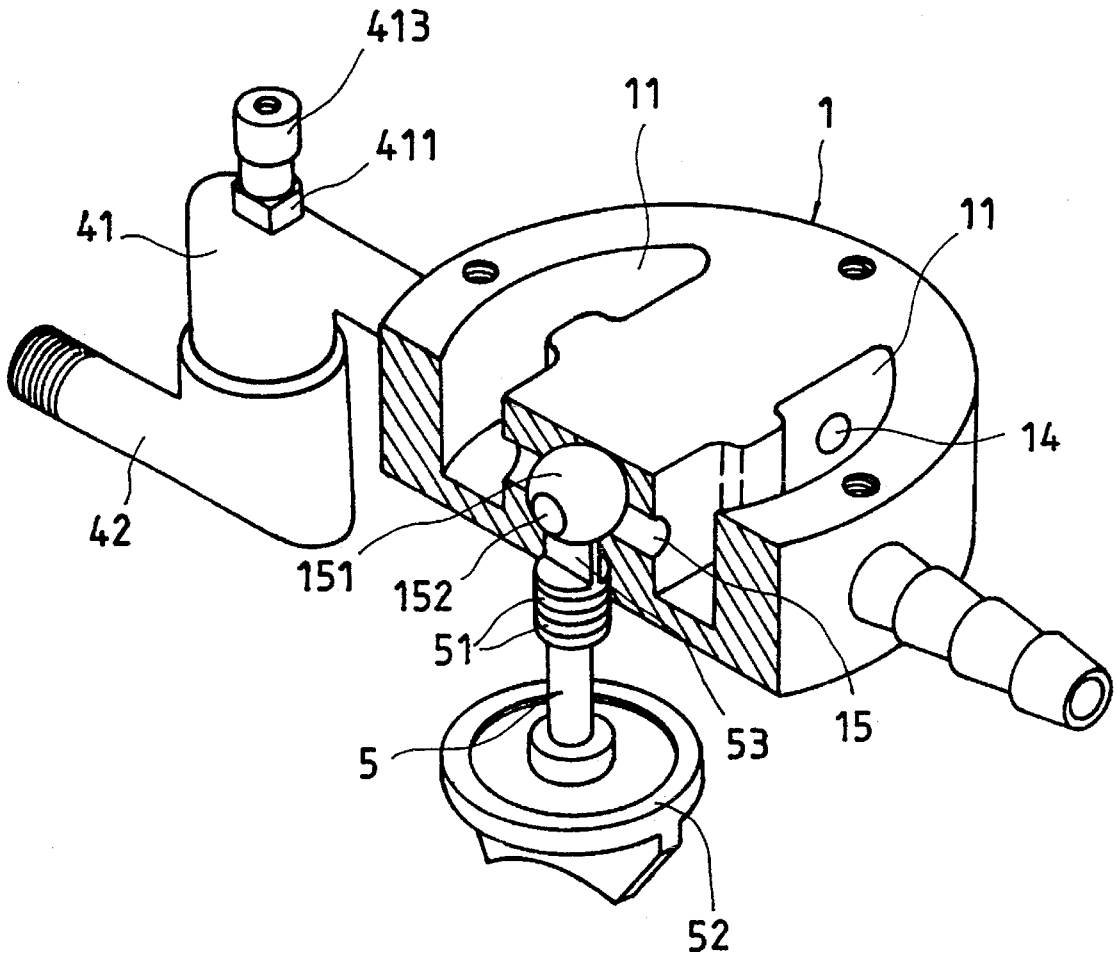
FIG. 11 is another elevational schematic view illustrating the manually operable valve means of the invention.

A timer 3 is disposed on top of the body 1 with a packing 13 provided therebetween. Multiple screws 34 are used to lock them firmly together. The second duct 141 provided at the intermediate partition 111 has disposed therein a spherical body 151 having a through hole 152 (see FIG. 12). The spherical body 151 further has a notch 153 formed at a bottom end thereof for receiving a projection of a rotary rod means 5 arranged therebelow. The rotary rod means 5 further has a plurality of washers 51 fitted thereon below the projection 53, and a rotary knob 52 at a lower end thereof. By means of the above arrangement, under the circumstances that electric power is not available, the spherical body 151 may be turned such that its through hole 152 aligns with the second duct 141 of the body 1 to connect gas. As shown in FIGS. 10, 10–12, the body 1 has a threaded hole 12 (see FIG. 2) at a lateral side thereof, and a pressure-differential sealing device 4 is screwably locked to the body 1 by means of the threaded hole 12.

The pressure-differential sealing device 4 consists of a first L-shaped connecting tube 41 interlocking with a second L-shaped connecting tube 42. The first L-shaped connecting tube 41 has a threaded opening 4121, and a control element 43 having a small-diameter inner bore 431 and a large-diameter inner bore 432 is screwably disposed at the threaded opening 4121. Multiple holes are circumferentially disposed at the outer wall of the large-diameter inner bore 432. A control rod 435 consisting of a rod body 4351 and a flange 4352 at a lower end thereof is disposed inside the control element 43. An annular groove 4353 is formed above the flange 4352 of the control rod 435 and is fitted with a washer 436. The small-diameter inner bore 431 of the control element 43 is provided with a pivot element 437 having a central hole 4371 and a periphery provided with multiple notches 4372. By means of the pivot element 437, the rod body 4351 of the control rod 435 may be positioned such that the control rod 435 may displace upwardly and downwardly within the pressure-differential sealing device 4.

Figure 9:
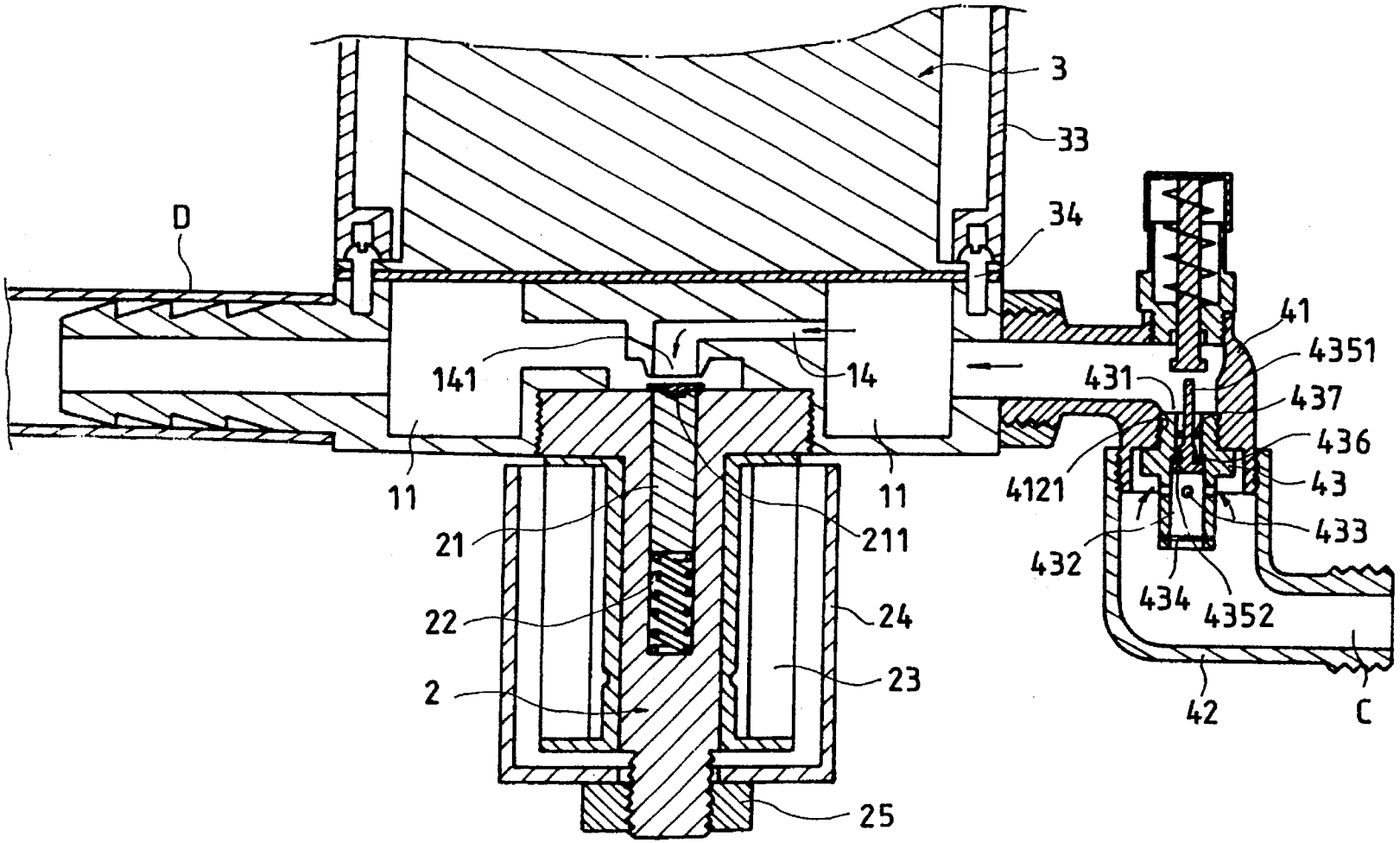
FIG. 9 is a sectional view of the gas leakage protection apparatus in which a control rod displaces upwardly to block the gas path.

Under normal circumstances, gas flows from a gas inlet C via the multiple holes 433 of the control element 43 into the spaces 11 of the body 1. But when a gas hose D cracks and gas leaks, due to increased pressure at the gas inlet C, the control rod 435 will displace upwardly to block the small-diameter inner bore 431, cutting off the gas (see FIG. 9). A baffle pin 434 is further insertably provided at a lower end of the control element 43 for positioning the control rod 435 at a specific location so that it may not fall down.

A threaded hole 412 is disposed at an upper portion of the first L-shaped connecting tube 41, and a press seat 411 is screwably locked to the threaded hole 412. The press seat 411 has a press cap 413 urged by a spring 4112 and a push rod 4113 disposed therein. When the control rod 435 displaces upwardly to cut off the gas flow, the press cap 413 may be pressed so that the push rod 4113 pushes the control rod 435 downwardly to cause the control rod 435 to reset.

Figure 1:
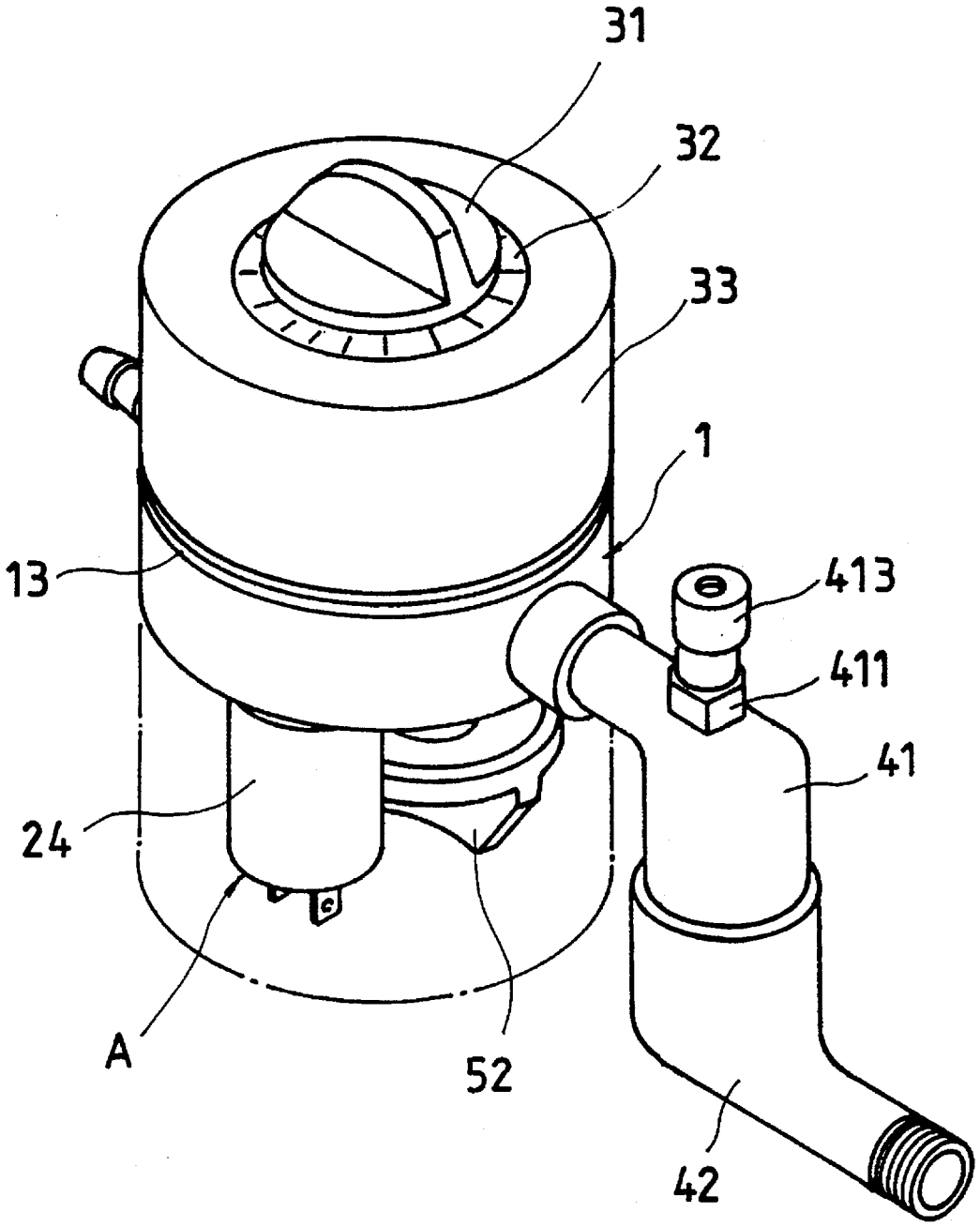
FIG. 1 is an elevational view of the gas leakage protection apparatus according to the present invention.
Figure 2:
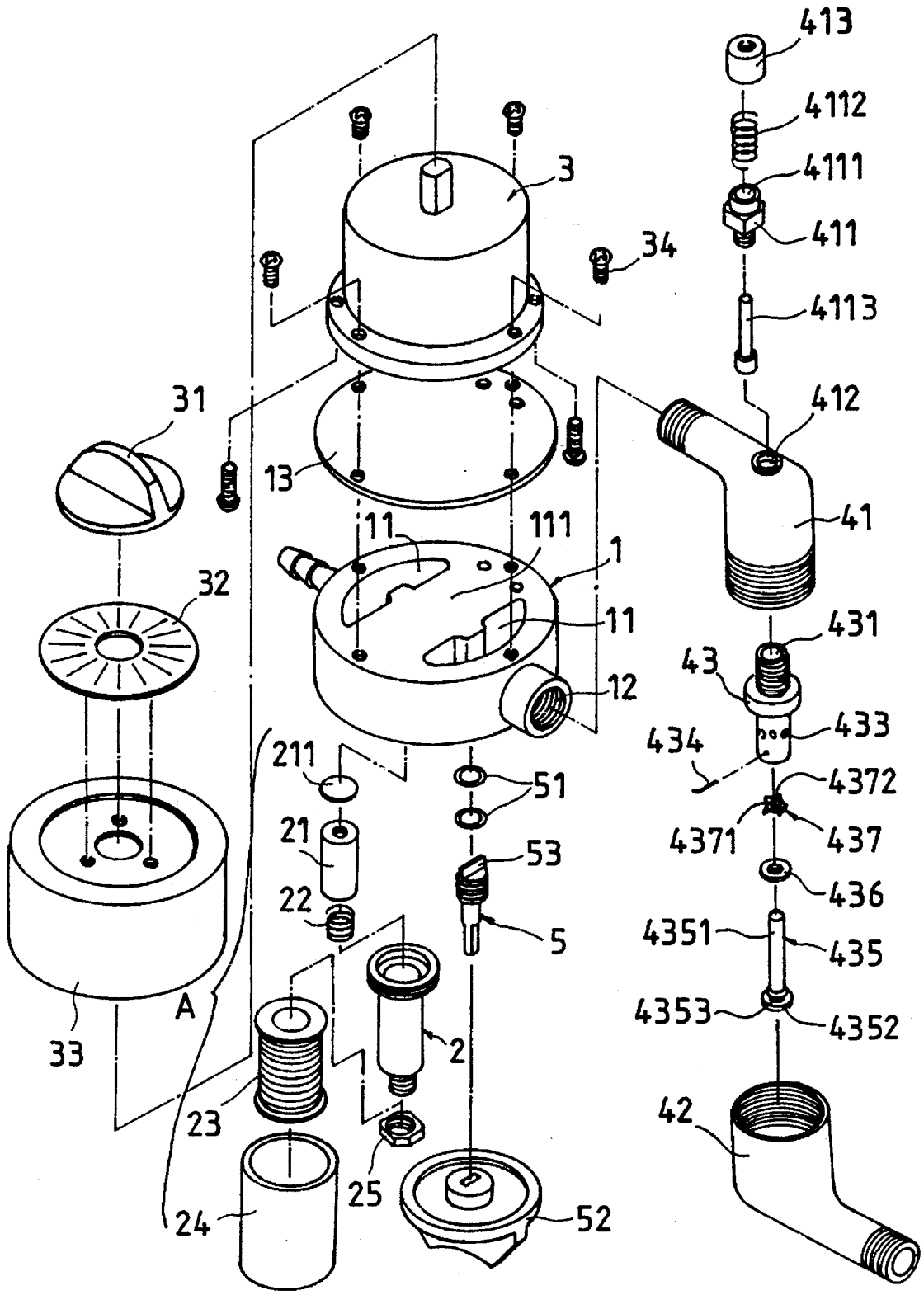
FIG. 2 is an elevational exploded view of the present invention.
Figure 3:
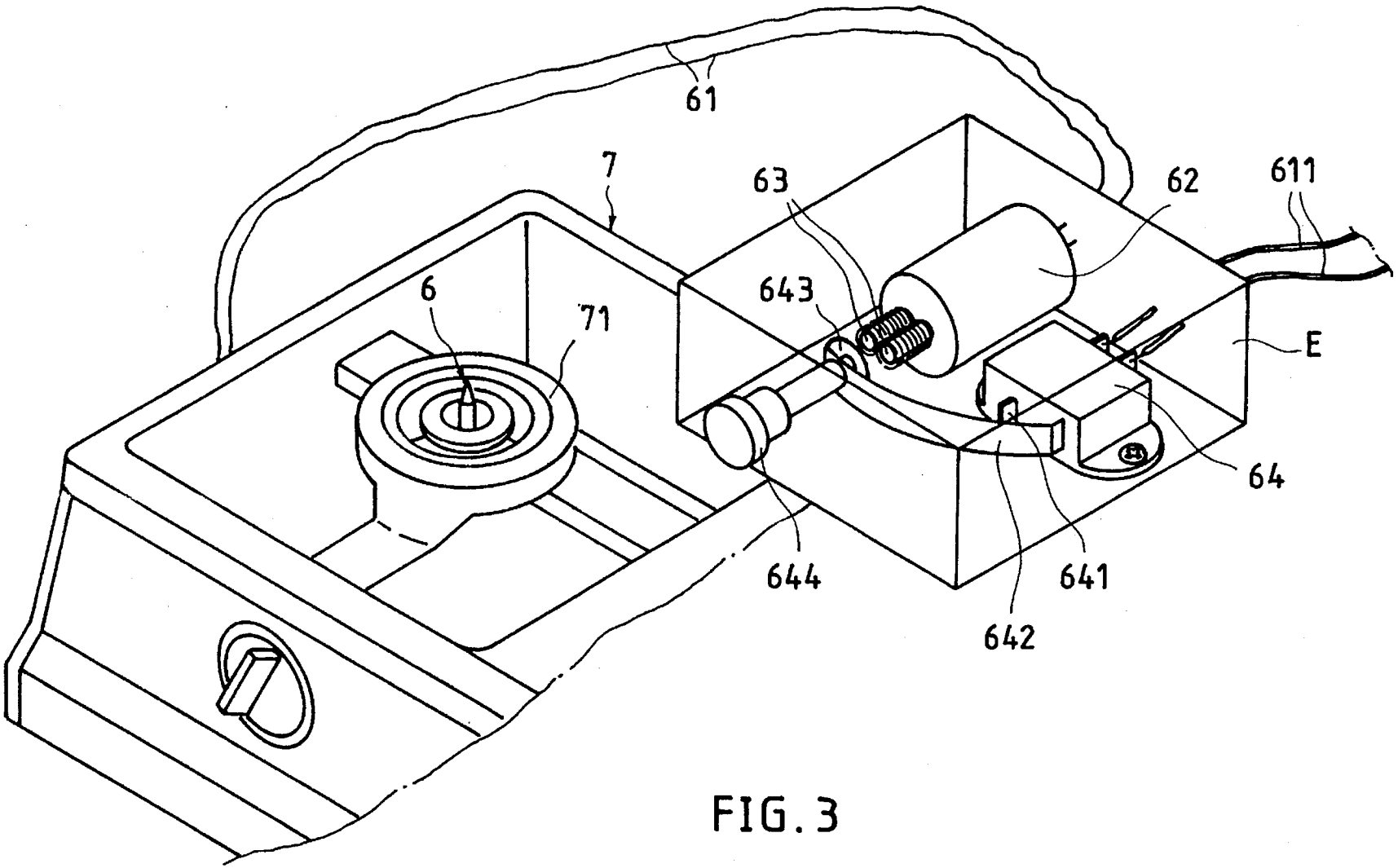
FIG. 3 is a schematic view showing a thermal electricity converting device and switch means of the present invention.
Figure 4:
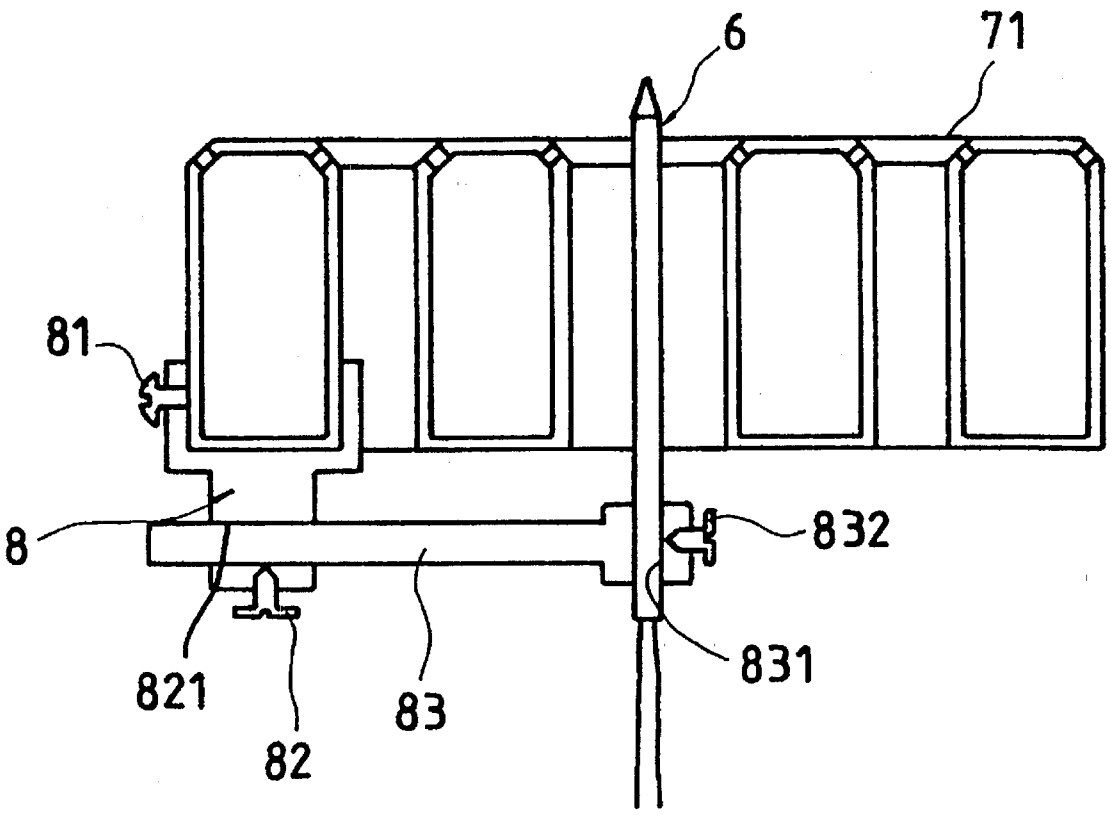
FIG. 4 is a sectional view showing the thermal electricity converting device mounted in a burner head.

With reference to FIGS. 3 and 4, a chuck 8 is locked to a bottom side of a burner head 7 by means of a screw 81. The chuck 8 has a through hole 821 at a bottom end thereof. A support rod 83 having a through hole 831 at one end thereof is inserted into the through hole 821 of the chuck 8, and a screw 82 is used to lock and position them. A heat-sensitive probe of a thermal electricity converting device is inserted through the through hole 831 of the support rod 83 and is locked by means of a screw 832 such that it extends upwardly a suitable distance.

Figure 5:
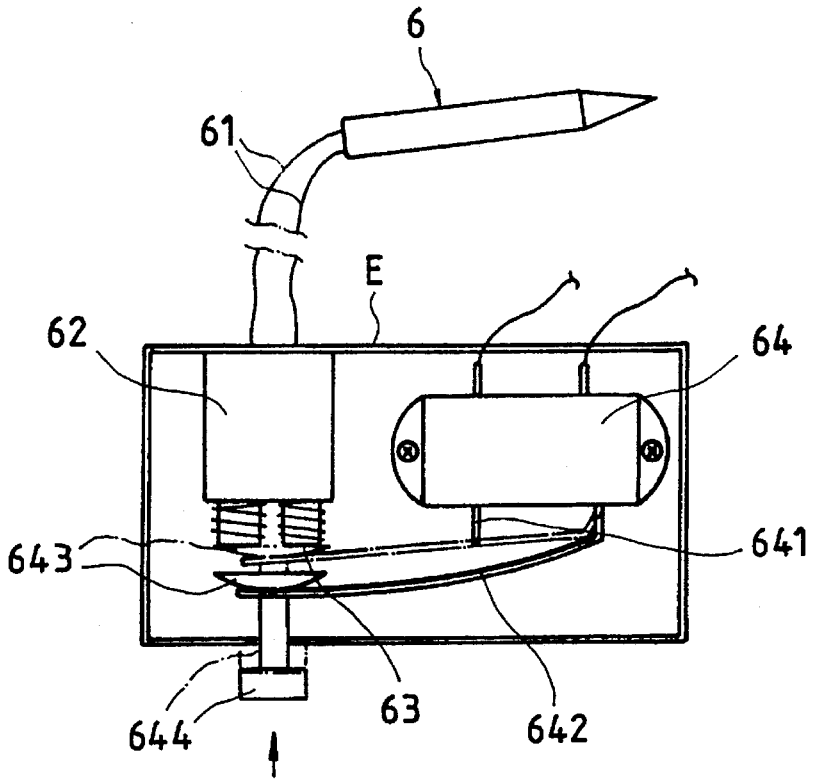
FIG. 5 is a schematic top view illustrating the working of the switch means.
Figure 6:
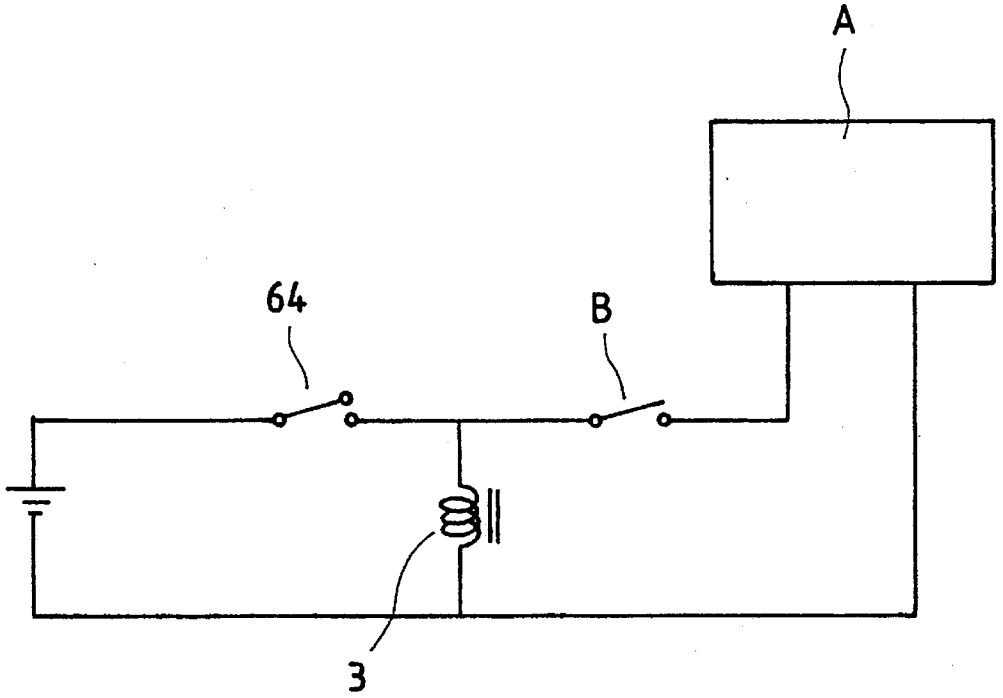
FIG. 6 is a simplified control circuit diagram of the present invention.
Figure 7:
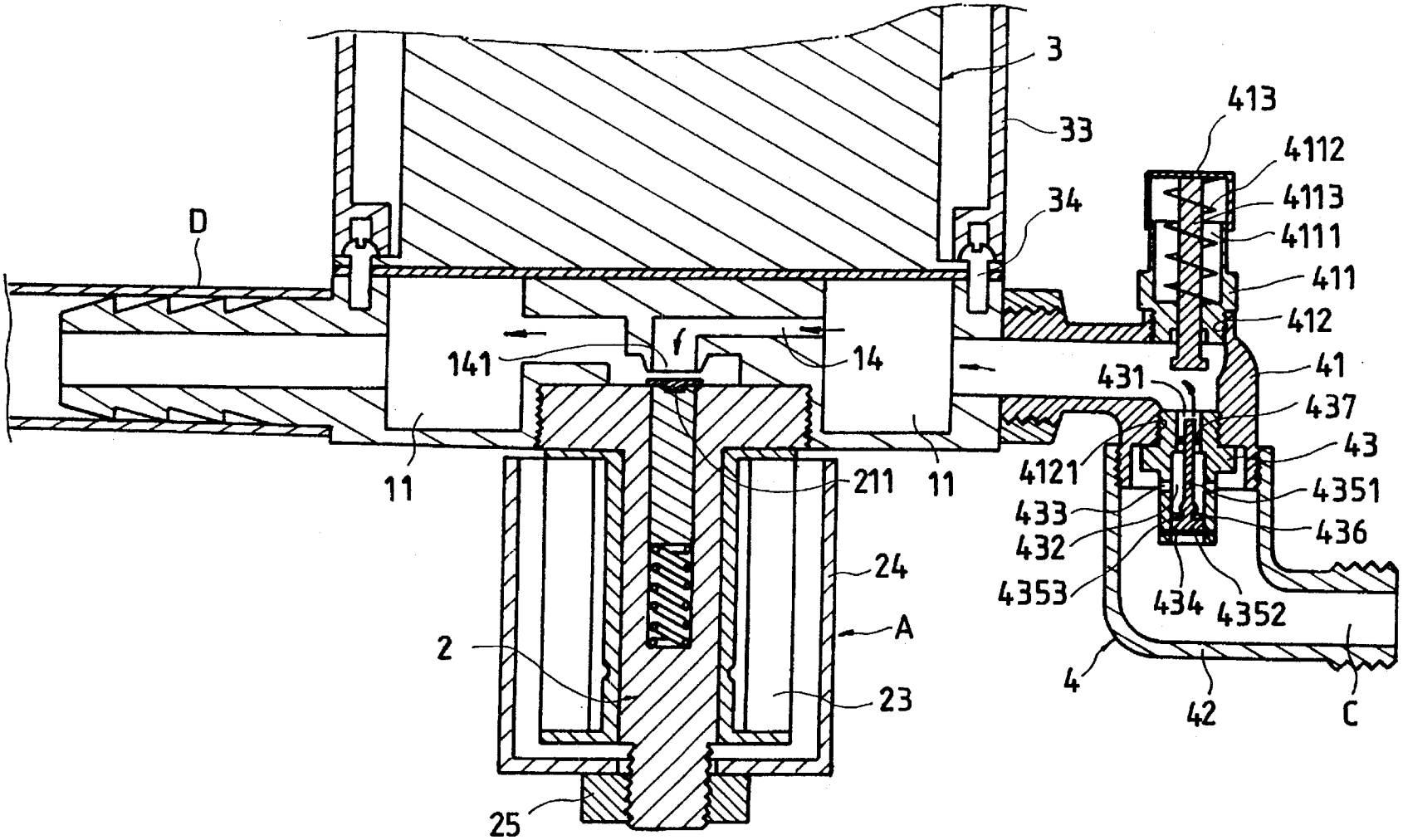
FIG. 7 is a sectional view of the gas leakage protection apparatus under normal conditions.

With reference to FIGS. 3, 5 and 6, a box E contains a coil 62 having a couple of sucking ends 63. At one side of the box E is a switch means 64 having an extension arm 642. The extension arm 642 is connected to a magnetizable disk 643 at an extreme end thereof. A press button 644 is disposed on the box E at a position relative to that of the magnetizable disk 643. In order to ignite a fire, the press button 644 is pressed so that electric currents are connected and the magnetizable disk 643 contacts the sucking ends of the coil 62 simultaneously. At this point, the rod 21 of the solenoid valve A retracts as a result of the magnetic force so that gas may pass through the first duct 141 to reach the burner head 71. Fire is ignited by turning a gas flow regulating valve. At this time, as a result of the heat-of the fire, the heat-sensitive probe 6 will convert the heat into electric energy which is conducted via a lead wire 61 to the coil 62, causing the sucking ends 63 to become magnetized so that the magnetizable disk 643 at the end of the extension arm 642 remains adhered thereto. As a result, the extension arm 642 may continually press the press button 641 of the switch means 64 to ensure smooth flow of electricity, thereby enabling the rod 21 of the solenoid valve A to remain retracted to ensure smooth gas flow.

If the fire is blown out by wind or extinguished by overflowing boiling water or soup, due to the drop in temperature, the heat-sensitive probe 6 stops supplying electricity to the sucking ends 63 of the coil 62 so that the magnetic force disappears, causing the extension arm 642 to reset and cut off electricity supply. As a result, the rod 21 of the solenoid valve A will block the first duct 151 due to the resilience of the spring 22, cutting off gas flow to ensure safety (see FIG.8).

Although the present invention has been illustrated and described with reference to the preferred embodiment thereof, it should be understood that it is in no way limited to the details of such embodiment but is capable of numerous modifications within the scope of the appended claims.

What is claimed is:

1. A gas leakage protection apparatus, comprising a cylindrical body of a suitable size having an intermediate partition for dividing the interior of said body into two spaces, the lateral sides of said intermediate partition being respectively provided with a first gas duct and a second gas duct, said first gas duct having a longitudinally oriented central hole, said cylindrical body having a solenoid valve screwably provided at a lower end thereof with respect to said central hole of said first gas duct, said solenoid valve having an inner hole accommodating therein a rod having a cock at an upper end thereof, said rod being perpendicular to said first gas duct and works in cooperation with said central hole of said first gas duct, said rod being urged by a spring to push against said central hole of said first gas duct when said solenoid valve is not connected with electricity;

a manually operable valve means consisting of a spherical body having a bottom notch accommodated within said second duct and a rotary rod means having an upper projection in engagement with said bottom notch; a timer locked to an upper side of said cylindrical body with a packing disposed therebetween by means of multiple screws;

a pressure-differential sealing device being screwably locked to a threaded hole at one lateral side of said cylindrical body, said pressure-differential sealing device consisting of a first L-shaped connecting tube interlocking a second L-shaped connecting tube, a control element having a small-diameter inner bore and a large-diameter inner bore being disposed in said first L-shaped connecting tube, said large-diameter inner bore having multiple holes circumferentially formed in an outer wall thereof, said control element accommodating therein an integrally formed control rod consisting of a rod body and a bottom flange, a washer being fitted into an annular groove above said bottom flange, a pivot element having a central hole and a periphery provided with multiple notches being disposed in said small-diameter inner bore of said control element for enabling said control rod to displace upwardly and downwardly, a baffling pin being insertably disposed at a bottom end of said control element for positioning said control rod at a specific position and preventing said control rod from dropping; and a thermal electricity converting device consisting of a heat-sensitive probe screwably locked in a through hole at one end of a support rod having the other end thereof inserted through a through hole of a chuck screwably locked at a bottom side of the burner head, said heat-sensitive probe extending upwardly and having a suitable length, said heat-sensitive probe being connected by a lead wire to a box which accommodates therein a coil with at least one sucking end and a switch means having an extension arm at one side thereof, a magnetizable disk being provided at an extreme end of said extension arm, and a press button being disposed on said box at a position relative to said magnetizable disk; said thermal electricity converting device incapable of generating electric energy when the fire is blown out or extinguished by overflowing boiling water or soup, thereby causing the magnetic force generated at said at least one sucking end of said coil to vanish and said extension arm to reset, disconnecting the circuit, said rod of said solenoid valve, as a result, displacing upwardly due to the resilience of said spring to block said central hole of said first gas duct to cut off gas flow.

* * * * *